US009839072B2

(12) United States Patent
Bohlender et al.

(10) Patent No.: US 9,839,072 B2
(45) Date of Patent: Dec. 5, 2017

(54) HEAT GENERATING ELEMENT WITH CONNECTION STRUCTURE

(71) Applicant: Eberspächer catem GmbH & Co. KG, Herxheim (DE)

(72) Inventors: Franz Bohlender, Kandel (DE); Michael Niederer, Kapellen-Drusweiler (DE)

(73) Assignee: Eberspacher catem GmbH & Co. KG, Herxheim (DE)

( * ) Notice: Subject to any disclaimer, the term of this patent is extended or adjusted under 35 U.S.C. 154(b) by 832 days.

(21) Appl. No.: 13/773,872

(22) Filed: Feb. 22, 2013

(65) Prior Publication Data

US 2013/0233845 A1 Sep. 12, 2013

(30) Foreign Application Priority Data

Mar. 8, 2012 (EP) ..... 12001601
Mar. 8, 2012 (EP) ..... 12001603

(51) Int. Cl.
*H05B 3/02* (2006.01)
*H05B 3/24* (2006.01)

(52) U.S. Cl.
CPC ..... *H05B 3/02* (2013.01); *H05B 3/24* (2013.01); *H05B 2203/02* (2013.01)

(58) Field of Classification Search
CPC ..... H05B 3/02; H05B 3/24; H05B 2203/02
USPC ..... 219/521, 524, 536, 538, 542, 546, 548; 392/347, 354
See application file for complete search history.

(56) References Cited

U.S. PATENT DOCUMENTS 3,940,591 A 2/1976 Ting
4,223,208 A 9/1980 Kleinschmidt et al.
4,255,645 A * 3/1981 Vitaloni ..... F23Q 7/00 219/265
4,449,036 A * 5/1984 Seibel ..... F23Q 7/00 219/264

(Continued)

FOREIGN PATENT DOCUMENTS

EP 0026457 A2 8/1981
JP 07230874 A 8/1995
WO 2009002431 A1 12/2008

OTHER PUBLICATIONS

European Search Report dated Aug. 7, 2012 for European Patent Application Serial No. EP 12 00 1601.

(Continued)

*Primary Examiner* — David Angwin
*Assistant Examiner* — John J Norton
(74) *Attorney, Agent, or Firm* — Boyle Fredrickson, S.C.

(57) ABSTRACT

A heat generating element includes at least one PTC element, contact sheets flatly lying against the PTC element on either side, a housing which forms at least one opening for receiving the at least one PTC element and which has a terminal side at which contact tongues allocated to the contact sheets are exposed. The device also has a wedge element with a broader and a narrower end face which are connected to each other via first and second wedge surfaces, the first wedge surface extending in parallel to one of the contact sheets and lying against it with a slide plate being inserted, and the second wedge surface being exposed at the outer side of the housing. A heat generating element less susceptible to damages during assembly has a slide plate connected to the housing.

21 Claims, 6 Drawing Sheets

(56) References Cited

U.S. PATENT DOCUMENTS

| | | | | |
|---|---|---|---|---|
| 4,723,195 | A * | 2/1988 | Mizzi | H01R 12/592 200/292 |
| 5,194,717 | A * | 3/1993 | Cowen | F04C 29/04 219/201 |
| 5,204,509 | A * | 4/1993 | Etters | H01H 1/62 219/201 |
| 5,443,853 | A * | 8/1995 | Hayes | B65D 41/3428 215/253 |
| 5,562,844 | A | 10/1996 | Bohlender et al. | |
| 5,653,550 | A * | 8/1997 | Mutz | E03C 1/33 4/633 |
| 6,431,058 | B1 * | 8/2002 | Binot | A47J 27/21041 219/438 |
| 8,704,123 | B2 * | 4/2014 | Rosenkranz | B23K 9/235 219/121.64 |
| 2005/0002661 | A1 * | 1/2005 | Henderson | F24H 1/182 392/478 |
| 2007/0068914 | A1 * | 3/2007 | Zeyen | F24H 3/0429 219/201 |
| 2007/0068927 | A1 * | 3/2007 | Bohlender | F24H 3/0405 219/505 |
| 2007/0084858 | A1 * | 4/2007 | Pierron | B60H 1/2225 219/716 |
| 2008/0099464 | A1 | 5/2008 | Niederer et al. | |
| 2008/0314893 | A1 | 12/2008 | Adair et al. | |
| 2009/0026194 | A1 | 1/2009 | Bohlender et al. | |

OTHER PUBLICATIONS

European Search Report dated Aug. 8, 2012 for European Patent Application Serial No. EP 12 00 1603.

* cited by examiner

HEAT GENERATING ELEMENT WITH CONNECTION STRUCTURE

BACKGROUND OF THE INVENTION

1. Field of the Invention

The present invention relates to a heat generating element with at least one PTC element, contact sheets flatly lying against it on either side, a housing forming at least one opening for receiving the at least one PTC element and having a terminal side where contact studs allocated to the contact sheets are exposed. The heat generating element according to the invention includes a wedge element with a broader and a narrower end face which are connected to each other via first and second wedge surfaces, the first wedge surface extending in parallel to one of the contact sheets and the second wedge surface being exposed at the outer side of the housing.

2. Description of the Related Art

Such a heat generating element is known from EP 1 921 896 A1. In this prior art, the housing is formed by two housing elements which can be connected to each other and are each formed as molded plastic parts. The contact sheet and insulation layers respectively provided at the outer side of it are coated with the plastic material forming the respective housing element to form a unit of contact sheet, insulation layer and housing element.

Such heat generating elements are in particular employed for heating liquids, for example in a motor vehicle. An electric heating device that normally accommodates several heat generating elements has one or several pockets extending in parallel with respect to each other. The pockets separate a circulation chamber for the fluid to be heated from a terminal side in which normally the electric contacts are exposed and connected. Since the chambers are formed from a metallic and thus electrically conductive material, for the operational reliability of the electric heating device, good electric insulation between the heat generating element inserted in the pocket and the walls delimiting the pocket inside is very important.

The generic heat generating elements are usually first inserted into the pocket. Then, the wedge element is shifted relative to the internal wall of the pocket and an outer surface of the heat generating element to wedge up the heat generating element in the pocket. The wedge element is lying with its first wedge surface in parallel to one of the contact sheets, usually with an insulation layer being inserted, and with its second wedge surface usually in parallel to a slightly beveled inner surface of the pocket. Correspondingly, through the medium of the wedge element, a flat contact between the heat generating element and the pocket results.

On one side, the other contact sheet lies against the inner surface of the pocket, usually also with an insulation layer being inserted, while on the other side, the wedge element is inserted. This arrangement is essential for an effective employment of the heat generating element as due to the self-regulating properties of the PTC elements, good, preferably symmetric and thus two-sided heat dissipation must be taken care of. Otherwise, the PTC element will get too hot and the self-regulating properties of the PTC element will prevent further absorption of electric energy for heat generation.

With the generic heat generating element, various problems arise. For example, when the wedge element is shifted, there is a risk in that the layers of a layer structure within the heat generating element are shifted with respect to each other. These layers include—from inside to outside—the PTC element, the contact sheets lying against it on either side, the insulation layers usually provided at their outer sides, where it is also possible to allocate several different insulation layers to each individual contact sheet, and finally the wedge element itself. In the above-mentioned prior art, the contact sheet is only inserted into the housing. At the base, it is supported on an edge of the housing. Furthermore, there is a problem in that on the one hand, the contact sheet must be all-over surrounded by an insulation layer which insulation layer must also cover edge regions of the contact sheet to reliably prevent an exposure of electrically conductive surfaces at the outer side of the heat generating element. The coating of the contact sheet together with the insulation layer known from prior art can lead to defects, in particular at the insulation layer, due to heat introduction during the injection molding process and/or due to the injection pressures prevailing in the process. Already microscopic fissures can cause high rejections as these are not correctly identified during production, so that defective heat generating elements are installed into the electric heating device and make it unusable altogether.

SUMMARY OF THE INVENTION

The present invention wants to provide a heat generating element which completely or partly avoids the above-described problems.

To achieve the above object, the generic heat generating element is further developed by the slide plate being connected to the housing. This prevents a relative movement between the slide plate and the housing. The slide plate can be connected to the housing with a form-fit, a frictional connection or by a material bond. To facilitate the assembly of the slide plate to the housing it is preferably connected to the housing with a form-fit. In view of the insertion direction of the wedge element, it should be preferred to connect the slide plate free from backlash to the housing at least at that end which is allocated to the narrower end face of the wedge element. The wedge element will move towards this end when the heat generating element is interlocked in the pocket. One, preferably several securing brackets are preferably provided at the slide plate at this narrower end, the securing brackets cooperating with one, preferably several correspondingly provided securing openings of the housing and are received in the latter.

According to a further preferred embodiment of the present invention, the slide plate is connected to the housing at its two opposed end regions. The opposed end regions are formed by those ends of the slide plate which are allocated on the one hand to the narrower end face and on the other hand to the broader end face of the wedge element and always extend essentially in parallel to these end faces. The corresponding end regions are accordingly usually situated in front of or behind the wedge element in its direction of motion. The slide plate is preferably connected to the housing with a form fit by a latching connection at its end allocated to the broader end face of the wedge element. This latching connection preferably comprises at least one latching web formed by the slide plate which cooperates with a counter surface provided on the side of the housing. The latching web is here usually formed by punching and bending the sheet material forming the slide plate and preferably projects over a front end of a sliding surface of the slide plate allocated to the wedge element and supporting the later flatly. The latching web is usually located in the width direction centrically at the slide plate and preferably cooperates with a latching projection arranged centrically at the housing and integrally formed with the latter. In this manner, a simple connection of the slide plate results.

The slide plate can first be introduced into the allocated securing opening of the housing via the securing bracket and prefixed there. Swiveling the latching web about the pivot formed thereby brings it behind the latching projection, so that the slide plate is latched with the housing at the opposed end regions of the housing. Both connections preferably are form-fit connections.

The slide plate furthermore preferably comprises retaining arms which movably hold the wedge element. This produces a structural unit, so that the heat generating element can be inserted into the pocket together with the wedge element movably retained at it. Compared to known prior art where the heat generating element is first introduced into the pocket and the wedge element is then introduced from above between the heat generating element and an inner surface of the pocket (cf. EP 1 921 896 A1), in this preferred further development, the heat generating element can be mounted as a unit and thus be easily positioned and mounted in the pocket. This embodiment itself can be essential for the invention. It should in particular be provided for a slide plate which is connected to the housing at opposed end regions, so that the slide plate on the one hand holds the wedge element and is on the other hand securely fixed to the housing, preferably connected to it by a form-fit. The retaining arms are usually spring arms which project from opposite edges of the slide plate, protrude over the sliding surface for the wedge element and are pretensioned to the inside towards the wedge element, so that these resilient retaining arms usually contact and fix the wedge element at side faces which connect the opposite wedge surfaces at the broader end face of the wedge element. It is possible to latch the slide plate with the housing for this fixing of the wedge element via the retaining arms only at one end side, i.e. the side allocated to the narrower end face of the wedge element, and to fix the wedge element by a housing part gripping over it such that the wedge element is lifted from the sliding surface. However, the mounting of the slide plate by a latching web which is allocated to the broader end face of the wedge element and cooperates with the housing is to be preferred as with such an embodiment, the housing can be formed with less efforts and in particular with a narrower design, thus reducing the cycle time for injection molding the housing and also simplifying the geometry of the mold cavity for forming the housing by the injection mold.

Preferably, at least one of the contact sheets comprises a bent-over tongue which is received in an insertion opening formed by the housing. Respective constitution may likewise define a parallel inventive concept of the present invention. The bent-over tongue essentially extends across a locating surface formed by the contact sheet and normally protrudes over this locating surface, i.e. it projects inwards towards the interior of the housing and extends in the thickness direction of the PTC element. Corresponding to this tongue, the housing has an insertion opening in which the tongue is received. The tongue is normally held in the insertion opening with little clearance, preferably without clearance. By the cooperation of the tongue and the insertion opening, the contact sheet is essentially immovably retained at the housing in a direction parallel to its locating surface for the at least one PTC element. The contact sheet is connected with the housing by inserting the tongue into the insertion opening only after the manufacture of the housing. The housing of the heat generating element can be correspondingly manufactured much more easily. It can in particular have a one-piece design, so that the housing is first manufactured as a simple, uniform molded part and later equipped with the layers forming the layer structure.

To largely avoid a weakening of the housing, it is suggested according to a preferred further development of the present invention to form the tongue by a cut-free insertion lug. This insertion lug has an essentially smaller width than the contact sheet at the lateral side of the contact sheet provided by the contact lug. The embodiment offers the further advantage that forces for introducing the insertion lug into the insertion opening can remain relatively small as the cooperating friction surfaces are kept relatively small, so that the frictional resistance when the tongue is inserted into the insertion opening is altogether relatively small.

This embodiment is especially relevant if, according to a preferred further development of the present invention, at least one latching projection latched with the housing projects from a surface of the tongue oriented essentially at right angles to a locating surface for the PTC element formed by the allocated contact sheet. In view of low introduction forces, the latching projection should be preferably formed as punctiform latching nose and latched with the housing. Several latching projections can be provided one next to the other at the surface oriented at right angles to the locating surface for the PTC element. The corresponding latching projection is preferably formed by processing the contact sheet by punching. It usually cooperates with a latching shoulder which is formed by the housing and is correspondingly formed with thin walls in view of the desired low introduction forces for joining the housing and the contact sheet, while it protrudes over the latching projection in the joined state, as is common with latching connections, and thus holds the contact sheet to the housing with a form-fit.

In this embodiment, the contact sheet can be prepared as a simple punched and bent part and then be joined with the housing in a simple manner. The contact sheet preferably includes a locating projection between the contact tongue and the locating surface for the at least one PTC element. The housing has a locating shoulder allocated to the locating projection. In this preferred embodiment, the housing and the contact sheet are dimensioned such that the tongue can be introduced into the insertion opening just by swiveling it about the locating shoulder when the contact projection is lying against the locating shoulder. In this embodiment, the locating projection and the locating shoulder allocated on the side of the housing function as assembly aid.

Usually, the locating shoulder is disposed in the region of a mounting for the contact tongue formed by the housing, preferably a contact lug formed by the contact sheet. The contact tongue does not necessarily have to be integrally formed at the contact sheet. However, such an embodiment is preferred. In any case, a contact lug formed by punching preferably protrudes over the contact sheet at its side opposite the tongue, which contact lug can form the contact tongue at the end side or be connected to it. Here, the mounting on the side of the housing and the contact lug form a guidance which has the effect that, in the course of the insertion motion of the contact lug into the mounting, the locating projection is inevitably placed against the locating shoulder. This abutment of the locating projection against the locating shoulder marks the end of the insertion motion for a mechanic. Then, the mechanic only has to swivel the contact sheet about the pivot formed in this manner to securely insert the tongue into the insertion opening. The walls of the mounting on the side of housing also form a positioning aid by which the tongue is roughly pre-positioned with respect to the insertion opening in the course of the swiveling motion of the contact sheet towards the housing.

The above described further development for the one contact sheet is preferably also provided for the other contact sheet, so that both contact sheets can be retained at the housing in the same manner and introduced into it and in the process prepositioned and latched with the housing with a form-fit.

The housing preferably has a through hole which is usually part of the above-described mounting for the contact lug. The through hole surrounds the contact lug and facilitates its assembly.

The above mentioned through hole is preferably formed by an obliquely oriented lead-through channel. The lead-through channel extends obliquely to the extension direction of the contact sheets which are normally provided in parallel to each other and which clamp the PTC elements between them. The lead-through channel is oriented so obliquely that the contact lug can be inserted through the lead-through channel in parallel to the walls defining the lead-through channel when the contact sheet is arranged at an angle relative to its final position. The lead-through channel is accordingly oriented obliquely from the interior, i.e. from the opening of the housing, to the outside towards the center (in the thickness direction) of the housing.

As was already mentioned before, the housing is preferably a housing formed in one piece. This integral housing only has one uniform housing body, the housing being formed in one piece and only realized as a uniform, inherently rigid and dimensionally stable component.

BRIEF DESCRIPTION OF THE DRAWINGS

Further details and advantages of the present invention can be taken from the following description of an embodiment in connection with the drawing. In the drawings.

DETAILED DESCRIPTION OF THE PREFERRED EMBODIMENT

Figure 1:
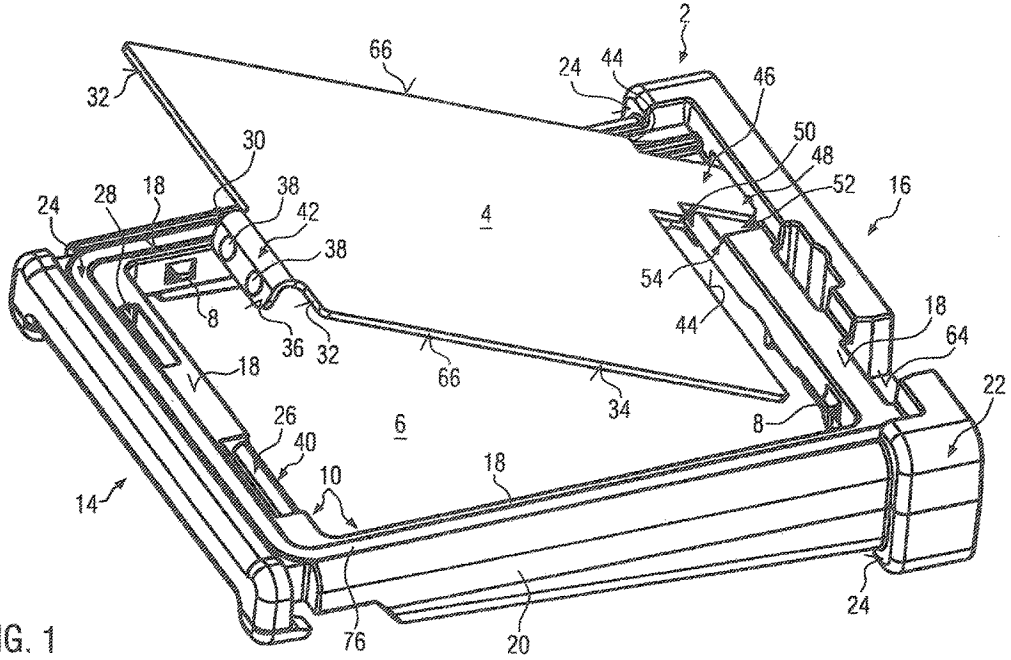
FIG. 1 shows a perspective plan view onto the embodiment from a first upper side.

FIG. 1 shows a housing of one embodiment designated with reference numeral 2 while this housing 2 is being connected with a first contact sheet 4. The housing 2 forms an opening 6 over the inner periphery of which spacer elements 8 protrude which are integrally formed at the housing 2 and have an essentially pyramidal shape, where the surfaces of the spacer elements 8 extending between a plane edge 10 of the opening 6 formed by the housing 2 and the tip of the spacer element 8 are of a concave shape. These spacer elements 8 are used for placing PTC elements against them which are designated with reference numeral 12 in FIG. 2. The spacer elements 8 retain the PTC elements 12 at a distance to the edge 10 and accordingly enlarge the leakage current path.

In a side view, the housing 2 has an essentially wedge-shaped design with a front narrow end 14 and a broader end which forms a terminal side 16 of the housing 2. The opening 6 is defined by lateral faces 18 which are provided on either side of the opening 6 and extend in parallel to each other. These lateral faces 18 completely surrounding the opening 6 are surrounded, in the longitudinal direction of the housing 2 and at the front end 14, by a slightly broadened external edge 20 which protrudes over the lateral faces 18 on both sides and has a wedge-shaped design in the longitudinal direction of the housing 2, i.e. it has a smaller width at the front end 14 than at the terminal side 16. At the terminal side 16, the housing 2 furthermore forms a surrounding and broadened collar 22 which externally protrudes over the contour of the outer edge 20 at the terminal side 16 and forms a support surface 24 by which the housing 2 installed in a pocket of an electric heating device is supported at its upper side on a heater housing of the electric heating device, as is known from EP 1 921 896 A1.

At the front end 14, the lateral face 18 provided there and extending transversely to the longitudinal extension of the housing 2 is penetrated by two insertion openings 26, 28. The insertion opening seen in the front in FIG. 1 and designated with reference numeral 26 serves to fix the contact sheet 4 shown in FIG. 1. For this, the latter includes a tongue 30 which protrudes over a front lateral face 32 of the contact sheet 4 and is formed by punching and bending. The tongue 30 accordingly has a smaller width than the contact sheet 4 in the region of the front lateral face 32 which protrudes slightly over the tongue 30 to the front—as seen in FIG. 1—and considerably to the rear. The tongue 30 is bent by 90° with respect to a locating surface 34 for the PTC elements 12 formed by the contact sheet 4 and protrudes inwards over this locating surface 34. The tongue 30 has an externally directed latching surface 36 extending at right angles to the locating surface 34 and over which two latching projections 38 protrude. The latching projections 38 are formed by punching the sheet material forming the contact sheet 4 and protrude over the latching surface 36 as convexly shaped latching noses.

The insertion opening 26 passes over, via a convexly curved mouth section 40, into the opening 6 which serves for locating a curved transitional region 42 between the locating surface 34 and the tongue 30. The mouth section 40 is located lower than the lateral face 18, so that in an installed condition, the contact sheet 4 is disposed flush with respect to the lateral face 18.

A contact lug 46 protrudes over a rear lateral face 44 of the contact sheet 4 at its end opposed to the tongue 30, which is, just like the insertion lug, provided with an essentially smaller width compared to the allocated lateral face 44 by punching it free and protrudes over it. At its free end, the contact lug 46 forms a contact tongue 48 via which the electrical connection to the contact sheet 4 is accomplished and which projects over the housing 2 at the terminal side 16. Between this contact tongue 48 and the locating surface 34 of the contact sheet 4, it forms a locating projection 50 which is provided by cutting out a step in the contact lug 46. For receiving a longitudinal region of the contact lug 46, the lateral face 18 is interrupted by a mounting 52 the base of which extends in parallel to the lateral face 18 and forms a locating surface for the contact lug 46. The edge 10 of the housing 2 that laterally defines the mounting 52 forms a locating shoulder 54 which is allocated to the locating projection 50 such that the latter abuts against it when the contact tongue 48 is inserted into a through hole 56 recessed at the housing 2, thus stopping the introduction motion. In this position, the locating projection 50 abuts against the locating shoulder 54 like a swivel joint. By a swiveling motion about this point, the tongue 30 is necessarily swiveled into the insertion opening 26 and fixed therein with a form-fit by cooperation of the latching projections 38 with a locking projection 58 formed on the housing side (cf. FIG. 6).

Figure 6:
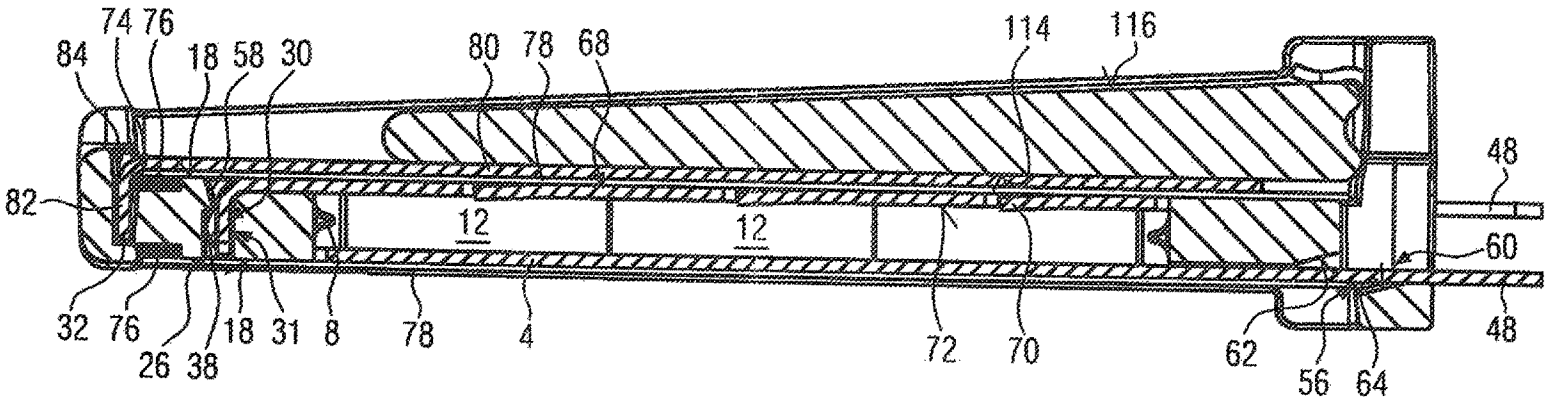
FIG. 6 shows a longitudinal section along a line extending in parallel to the central longitudinal axis which intersects the tongue of a contact sheet.

As can be in particular seen in FIG. 6, the through hole 56 is formed by an obliquely oriented lead-through channel 60. This oblique lead-through channel 60 is formed by a flattening 62 oriented towards the center—in the width direction—and to the outside, which extends from the lateral face 18 and a flattening 64, which extends in parallel thereto and is provided opposite to it, and which is formed at a wall of the collar 22 internally defining the through hole 56. For forming the lead-through channel 60, only the flattening 64 might be provided and the oblique surface 62 omitted.

In the width direction of the embodiment, the oblique lead-through channel 60 correspondingly extends from the lateral face 18 to the outside towards the terminal side 16 towards the center in the width direction. By this, the introduction of the contact lug 46 through the through hole 56 is facilitated when the contact sheet 4 is oriented obliquely to the lateral face 18. The walls limiting the through hole 56 furthermore lead to an orientation of the contact sheet 4 with its longitudinal edges 66 in parallel to the allocated edges 20 of the housing 2, so that the contact sheet 4 is already oriented, after the contact lug 46 has been inserted into the through hole 56, such that the tongue 30 is flush with the insertion opening 26.

Figure 2:
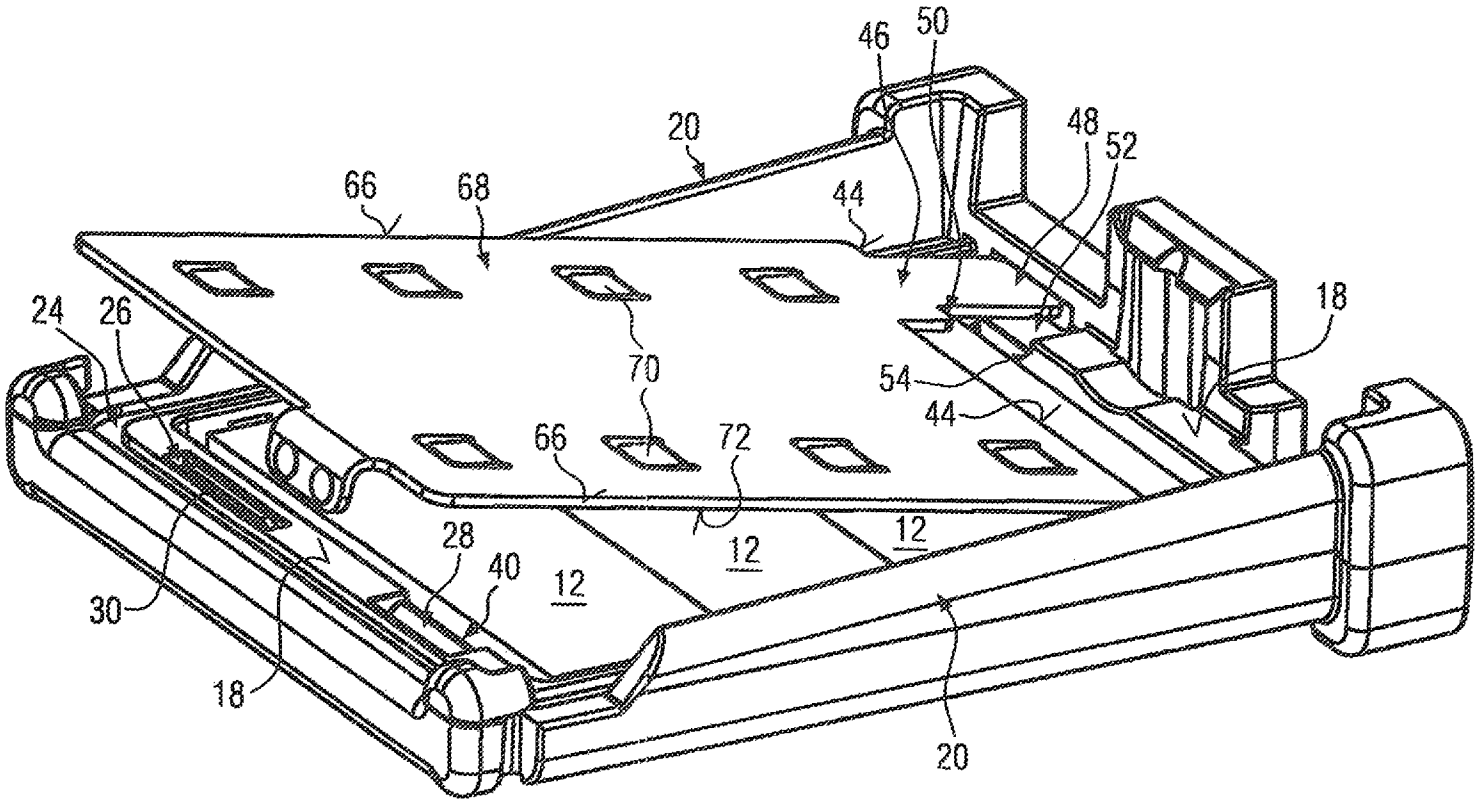
FIG. 2 shows a perspective plan view onto the embodiment from a second upper side.

After the contact sheet 4 has been connected with the housing 2 in the above described manner, in the course of the assembly, the housing 2 is rotated, so that the side shown at the top in FIG. 1 is at the bottom. This position is illustrated in FIG. 2. Now, several, in the present case four, PTC elements 12 are introduced into the opening 6 closed at the bottom side by the contact sheet 4, and they are placed onto the locating surface 34 of the contact sheet 4. Then, a further contact sheet 68 formed essentially identically to the contact sheet 4 is oriented at the housing 2 in the manner described above with reference to FIG. 1 and latched with the latter. The contact sheet 68 is essentially identical to the contact sheet 4, the difference being that spring tongues 70 formed by punching and bending are formed facing the individual PTC elements 12 for improving electric contacting, the spring tongues 70 protruding over a plane locating surface 72 of the contact sheet 68.

As is illustrated in FIGS. 1 and 2, between the latching surface 18 and the outer edge 20, a U-shaped groove 74 is recessed. This groove 74 surrounds the contact sheet 4 and 68, respectively, mounted in the manner described above in a U-shape and serves to receive a sealing compound 76 which is introduced into the groove 74. This sealing compound 76 can have sticky properties and serves the sealing and optionally also fixing of an insulation layer designated with reference numeral 78 to the outer side of the contact sheet 4 and 68, respectively. This insulation layer 78 in the present case has a two-layer structure with a silicone film and a glass fiber mat connected to it. Such an insulation layer 78 exhibits high electric strength and can be manufactured with an exact thickness as an essentially incompressible insulation layer 78.

After the insulation layer 78 has been applied onto the lateral faces 18, the contact sheets 4 and 68, respectively, are insulated against the surrounding area. Then, a slide plate designated with reference numeral 80 is placed onto the in FIG. 2 upper side. At its end allocated to the front end 14 of the housing 2, this slide plate 80 has two securing brackets 82 which are each separately formed essentially identical to the tongues 30, the difference being that only one latching projection 38 protrudes over each of the securing brackets 82. Corresponding to the two securing brackets 82 provided in the width direction one next to the other, securing openings 84 are recessed at the housing 2. The slide plate 80 is introduced with its securing brackets 82 into the allocated securing openings 84 in the manner described above with reference to the contact sheet 4 and connected with the housing 2 with a form-fit. As is illustrated in FIG. 6, the securing openings 84 are slightly broadened upwards, so that the slide plate 80 can be swiveled about the pivot formed between the securing opening 84 and the securing bracket 82 within limits. After the securing brackets 82 have been introduced into the securing openings 84, the slide plate 80 assumes the position shown in FIG. 3. Then, the slide plate 80 is placed against the housing 2 with its whole surface.

At its front end 86 facing the terminal side 16, the slide plate 80 comprises a latching web 88 which is formed by punching and bending the sheet material forming the slide plate 80, and a sliding surface 90 formed by the slide plate 80, and it has a hook-like design, so that the latching web 88 forms a first section 92 extending essentially at right angles to the sliding surface 90 and a second section 94 also extending at right angles thereto and in parallel to the sliding surface 90 to the inside. For increasing the flexural strength of the latching web 88, the latter is penetrated by a bead 96 formed by bending and extending in the longitudinal direction of the housing 2, the bead being bent to the outside. The second section 94 has a free end broadening like a funnel towards the outside.

By punching and bending, flanks 98 are formed in the upper third of the slide plate 80, i.e. in the region allocated to the terminal side 16, the flanks limiting the sliding surface 90 at the edge but in the mounted state not protruding over the lateral faces 18 to a greater extent than the wedge-shaped outer edges 20 at the level of the corresponding flanks 98. At the terminal side, the flanks 98 pass over into spring arms 10 which are cut free with respect to the sliding surface 90 and bent to the inside.

Figure 3:
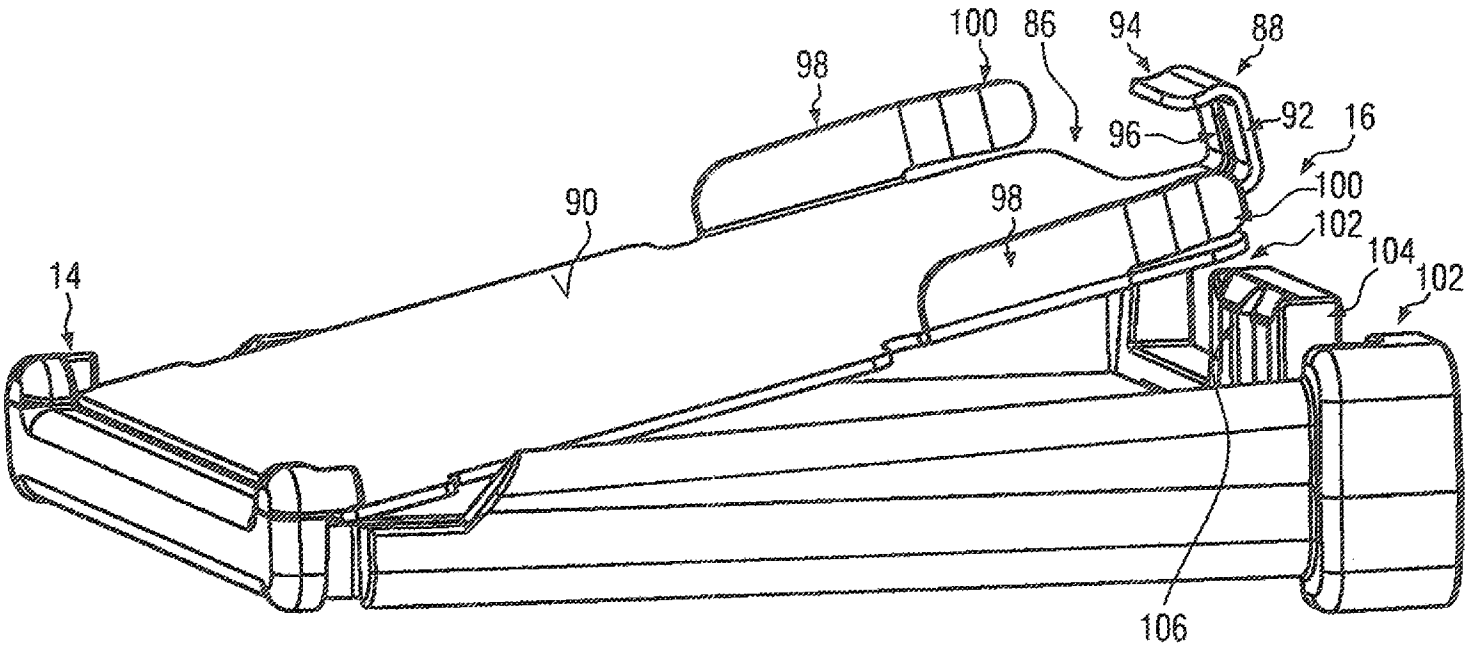
FIG. 3 shows a perspective view similar to FIG. 2 while the slide plate is being connected.
Figure 4:
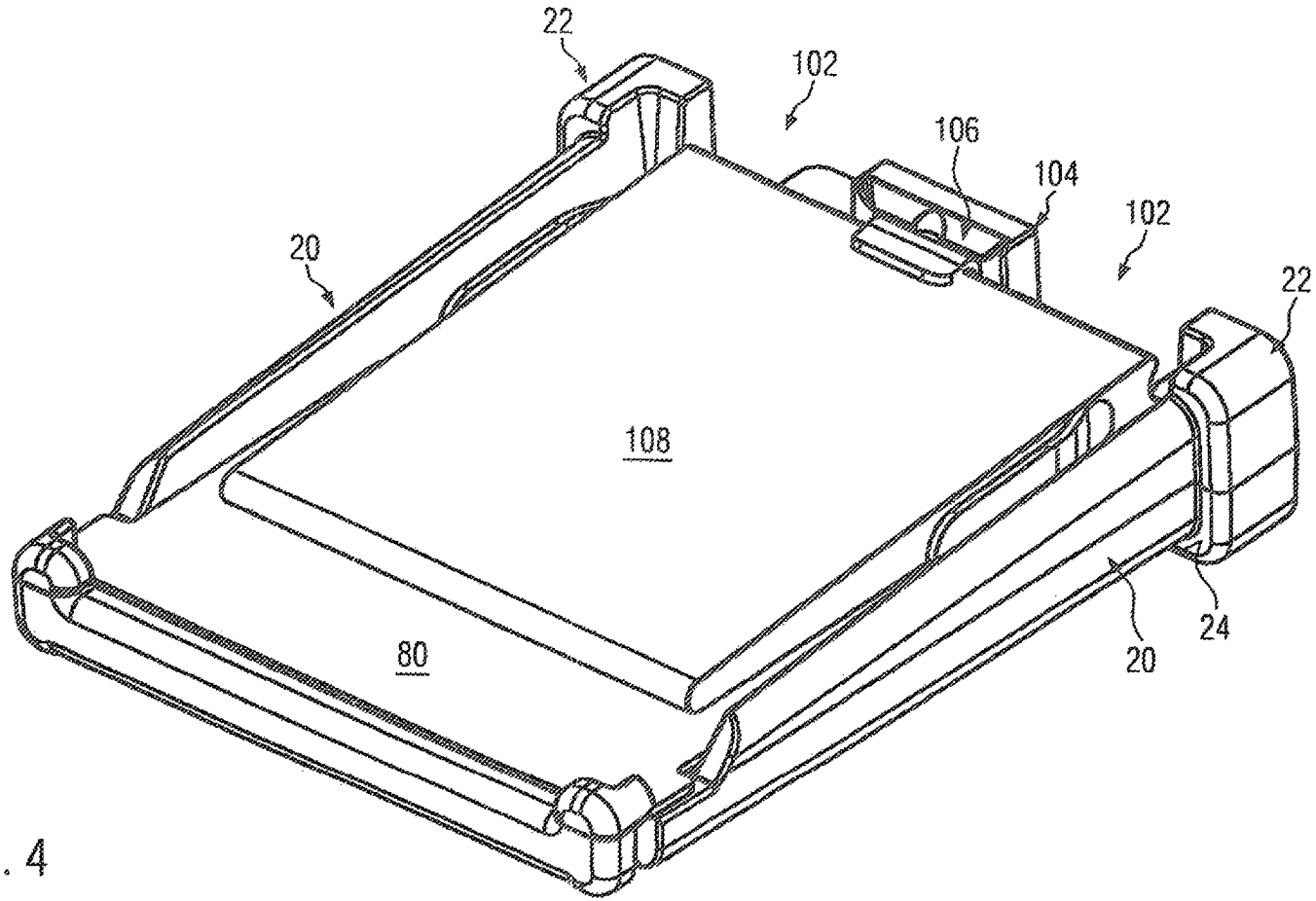
FIG. 4 shows a perspective plan view similar to FIG. 2 after the final assembly of the embodiment.

On the side shown in FIGS. 2 to 4, the collar 22 is provided with two large through holes 102 between which a support web 104 is integrally formed at the housing 2 which forms an internally projecting latching projection 106 at its free end. The latching projection 106 lies within an enveloping surface around the collar 22.

Figure 5:
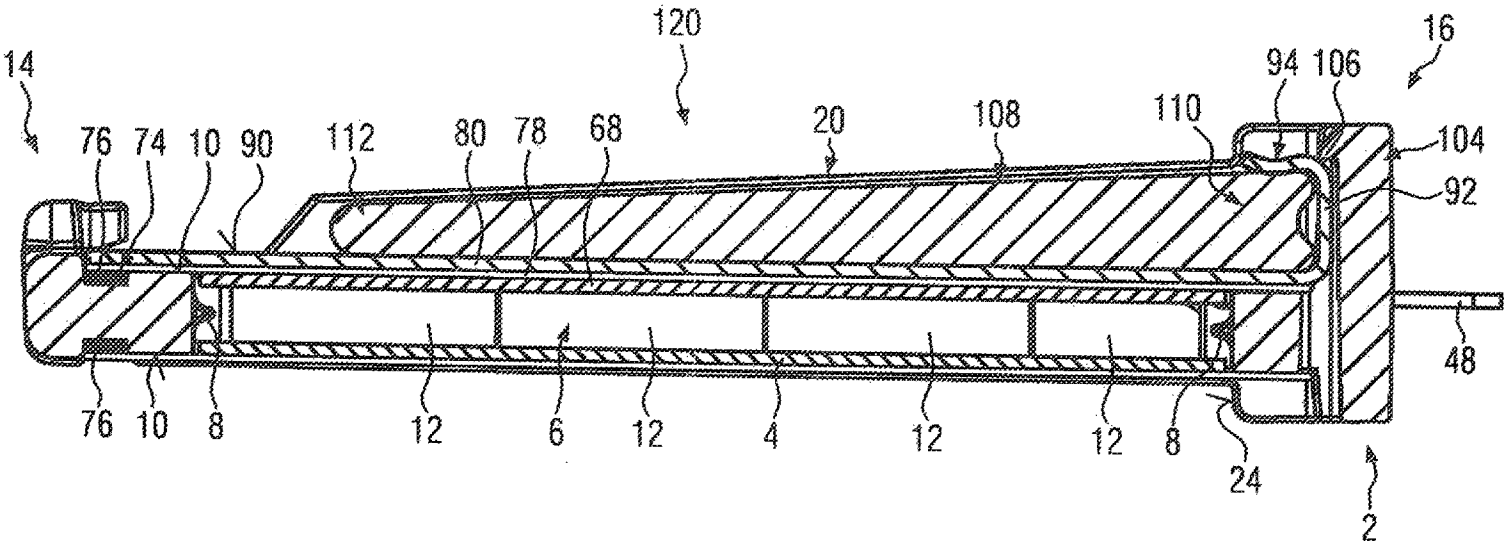
FIG. 5 shows a longitudinal section along the central longitudinal axis of the completely mounted embodiment shown in FIG. 4.

When the slide plate 80 is swiveled from the preliminary orientation shown in FIG. 3 to the final position shown in FIGS. 4 to 6, the latching web 88 is urged to the inside by the latching projection 106 and springs back when the final position of the slide plate 80 is reached, so that the slide plate 80 is also retained to the housing 2 with a form-fit at the terminal side 16.

Now, a wedge element designated with reference numeral 108 is placed onto this slide plate 80 connected in this manner with the housing 2 at opposite end regions (cf. FIGS. 4 to 6). The wedge element 108 has a broader end face designated with reference numeral 110 which is allocated to the terminal side 16, and a narrower end face designated with reference numeral 112 which is allocated to the front end 14. The wedge element 108 has such a width that the wedge element 108 is non-positively held between the spring arms 100. In the starting position shown in FIG. 4, the wedge element 108 is furthermore gripped over by the second section 94 of the latching web 88 and correspondingly held between this section 94 and the sliding surface 90 in a form-fit. In this starting position, a first wedge surface designated in FIG. 6 with reference numeral 114 is in parallel to the sliding surface 90 which in turn extends in parallel to the contact sheet 68, whereas a second wedge surface designated with reference numeral 116 is exposed at the outer side of the housing 2. In the starting position shown in FIG. 6, this second wedge surface 116 is still slightly underneath the contour given by the outer edge 20. By shifting from the right to the left (according to FIG. 6) and due to the wedge-shaped design of the wedge element 108 with an angle of about 3°, the wedge element 108 finally protrudes over this contour and accordingly interlocks the embodiment of a heat generating element 120 illustrated in FIGS. 4 to 6 in a conical pocket of an electric heating device. On the side opposite the wedge element 108, the insulation layer 78 is exposed at the housing 2 and is approximately flush with the contour of the edge 20 provided at this side. Usually, the insulation layer 78 slightly protrudes over this edge.

As illustrates in particular FIG. 5, the front free end of the second section 94 of the latching web 88 is still within the support surface 24, so that the positioning of the heat generating element 120 at the heater housing is not affected by the mounting of the wedge element 108. The insertion of the wedge element is done by introducing two tool projections through the through hole 102. The wedge element 108 has a cavity at its broadened end 110, so that the corresponding tools are well positioned at the wedge element 108.

What is claimed is:

1. A heat generating element comprising:

a PTC element, a first contact sheet flatly lying against the PTC element on a first side thereof, a second contact sheet flatly lying against the PTC element on a second side thereof, a housing which forms an opening for receiving the PTC element and which has a terminal side at which contact tongues allocated to the contact sheets are exposed, and a wedge element with a broader end face and a narrower end face which are connected to each other via first and second wedge surfaces, the first wedge surface extending in parallel to one of the contact sheets and lying against the one contact sheet with a slide plate being inserted therebetween, the slide plate having opposing spring arms, and the second wedge surface being exposed at the outer side of the housing, wherein a portion of the slide plate is connected with a securing opening of the housing so that the slide plate is held in a non-slidable manner that prevents a relative movement between the slide plate and the housing, and wherein the wedge element is held between the opposing spring arms and the portion of the slide plate.

2. The heat generating element according to claim 1, wherein the slide plate is connected to the housing with a form-fit.

3. The heat generating element according to claim 1, wherein the portion of the slide plate is a securing bracket which is received in the securing opening formed through the housing.

4. The heat generating element according to claim 3, wherein the securing opening is allocated to the narrower end face of the wedge element.

5. The heat generating element according to claim 1, wherein the slide plate is connected with the housing at opposite end regions of the housing.

6. The heat generating element according to claim 1, wherein, through the slide plate, the wedge element is secured to the housing.

7. The heat generating element according to claim 1, wherein the contact sheets are secured to the housing after formation thereof.

8. The heat generating element according to claim 1, wherein at least one of the contact sheets has a bent-over tongue received in an insertion opening of the housing.

9. The heat generating element according to claim 8, wherein at least one latching projection which is latched with the housing projects from a surface of the tongue oriented essentially at right angles to a locating surface for the PTC element.

10. A heat generating element comprising:

a PTC element, a first contact sheet flatly lying against the PTC element on a first side thereof and a second contact sheet flatly lying against the PTC element on a second side thereof, a housing which forms an opening for receiving the PTC element, which forms a latching projection, and which has a terminal side at which contact tongues allocated to the contact sheets are exposed, and a wedge element with a broader end face and a narrower end face which are connected to each other via first and second wedge surfaces, the first wedge surface extending in parallel to one of the contact sheets and lying against the one contact sheet with a slide plate being inserted therebetween, the slide plate having opposing spring arms, and the second wedge surface being exposed at the outer side of the housing, wherein the slide plate is connected to the housing with a form-fit at an end thereof allocated to the broader end face of the wedge element by a latching connection which has at least one resilient latching web formed by the slide plate and received by the latching projection, wherein the slide plate is provided with a securing bracket received within a securing opening of the housing so that the slide plate is held in a non-slidable manner that prevents a relative movement between the slide plate and the housing, and wherein the wedge element is held between the opposing spring arms and the latching connection provided by the slide plate.

11. The heat generating element according to claim 10, wherein the latching web protrudes over a front end of a sliding surface allocated to the wedge element and supporting it flatly.

12. The heat generating element according to claim 10, wherein the latching projection is centrically disposed at the housing and integrally formed to the housing.

13. The heat generating element according to claim 10, wherein the latching web grips over the wedge element.

14. A heat generating element comprising:

a PTC element, a first contact sheet flatly lying against the PTC element on a first side thereof, a second contact sheet flatly lying against the PTC element on a second side thereof, a housing which forms an opening for receiving the PTC element and which has a terminal side at which contact tongues allocated to the contact sheets are exposed, and a wedge element with a broader end face and a narrower end face which are connected to each other via first and second wedge surfaces, the first wedge surface extending in parallel to one of the contact sheets and lying against the one contact sheet with a slide plate being inserted therebetween, the slide plate having opposing spring arms, and the second wedge surface being exposed at the outer side of the housing, wherein a securing bracket of the slide plate is inserted into a securing opening of the housing so as to hold the slide plate in a non-slidable manner that prevents a relative movement between the slide plate and the housing, and wherein the wedge element is held between the opposing spring arms and the securing bracket of the slide plate.

15. The heat generating element according to claim 14, wherein the slide plate is connected to the housing with a form-fit.

16. The heat generating element according to claim 14, wherein the securing opening is allocated to the narrower end face of the wedge element.

17. The heat generating element according to claim 14, wherein the slide plate is connected with the housing at opposite end regions of the housing.

18. The heat generating element according to claim 14, wherein, through the slide plate, the wedge element is secured to the housing.

19. The heat generating element according to claim 14, wherein the contact sheets are secured to the housing after formation thereof.

20. The heat generating element according to claim 14, wherein at least one of the contact sheets has a bent-over tongue received in an insertion opening of the housing.

21. The heat generating element according to claim 20, wherein at least one latching projection which is latched with the housing projects from a surface of the tongue oriented essentially at right angles to a locating surface for the PTC element.

* * * * *